United States Patent [19]

Thiry et al.

[11] Patent Number: 5,032,759

[45] Date of Patent: Jul. 16, 1991

[54] GLASS LAMP BASE

[75] Inventors: William G. Thiry, Winchester, Ky.; Richard K. Fleegal, Camp Hill, Pa.

[73] Assignee: GTE Products Corporation, Danvers, Mass.

[21] Appl. No.: 457,052

[22] Filed: Dec. 26, 1989

[51] Int. Cl.[5] ..... H01J 5/48

[52] U.S. Cl. ..... 313/318; 439/611; 439/613

[58] Field of Search ..... 313/318, 580; 439/611, 439/612, 613, 614; 445/23, 27; 220/2.1 R, 2.2

[56] References Cited

U.S. PATENT DOCUMENTS

| | | | |
|---|---|---|---|
| 3,796,528 | 3/1974 | Smith | 425/123 |
| 3,840,954 | 10/1974 | Hasell et al. | 445/27 |
| 4,020,382 | 4/1977 | Bolt et al. | 313/318 |

FOREIGN PATENT DOCUMENTS

| | | | |
|---|---|---|---|
| 0659175 | 3/1963 | Canada | 439/611 |
| 0750096 | 6/1956 | United Kingdom | 439/611 |

*Primary Examiner*—Donald J. Yusko
*Assistant Examiner*—Ashok Patel
*Attorney, Agent, or Firm*—William E. Meyer

[57] ABSTRACT

A glass lamp base may be formed by thinning the glass base in the area behind the point where the side lead is welded to the exterior surface of the screw. Thinning the glass behind the weld area helps assure that the remaining glass is firmly positioned to the back of the screw in the area of the weld, and has not slumped away from the screw. Assuring the glass backing is present, increases the likelihood of a successful weld, and functional lamp.

17 Claims, 4 Drawing Sheets

GLASS LAMP BASE

TECHNICAL FIELD

The invention relates to electric lamps and particularly to molded glass bases. More particularly the invention is concerned with electric lamps with molded glass bases having a lead welded to the exterior of the base

BACKGROUND ART

The molded glass base for a screw type lamp, and in particular the base for larger flood lamps, is formed by coaxially positioning an eyelet, a threaded contact shell, and a lamp skirt in a mold. A gob of molten glass is then dropped in axially to cover the eyelet, and partially fill the volume of the shell. In a series of press moldings, the glass is forced to seal with the inner surfaces of the eyelet, and shell. The volume of glass pressed against the interior surface of the shell is forced to the edge of the shell where the glass flows around the end of the lamp skirt. During the series of moldings, a central lead channel is formed extending from the interior of the base through the eyelet. The eyelet lead channel subsequently receives, and has one of the lamp leads soldered or welded in place. In a similar fashion, a second lead channel is formed to pass through or around an end of the glass forming a side channel leading to the shell. A second lamp lead is passed through the second channel, and flattened against the exterior surface of the shell in a weld zone. The exposed end of the second lamp lead is then pressed hard against the weld zone of the shell and welded. The lamp may then be lit by providing power to the eyelet contact and the shell contact.

A problem may be encountered when the molded glass fails to seal with the shell opposite the weld zone. A gap then exists between the molded glass and the shell in the area of the second lead channel. When the second lead is welded to the shell, there is no solid glass wall bracing the weld zone of the shell, the shell flexes when the lead is pressed against the shell by the welding tool. The lead and shell are then not held as tightly against one another during welding as when the glass is properly sealed to the shell. The normally adequate weld pressure and heat are then inadequate when the second lead is welded, causing the weld to fail. The weld failure has occurred in from two to five percent of production, resulting in wasted material and energy. There is then a need to enhance the seal between the glass body and shell at least in the weld zone.

Examples of the prior art are shown in U.S. Pat. Nos. 3,796,528 and 3,840,954. Chrisman O. Smith U.S. Pat. No. 3,796,528 for Apparatus for Manufacturing an Electric Lamp Base that has a Snag-Proof Terminal issued Mar. 12, 1974 shows the lamp base structure and discusses the method of making molded lamp bases. Richard F. Hasell et al U.S. Pat. No. 3,840,954 for Method of Manufacturing and assembling an Electric Lamp Base shows a lamp base with a cemented in place lamp envelope.

DISCLOSURE OF THE INVENTION

An improved glass lamp base may be formed as a molded glass base in the general form of a cylindrical walled body, having an axis, an exterior surface and an interior surface defining a first wall thickness. The interior surface further defines an interior cavity, having a first lead channel extending from the interior cavity through the wall to the exterior. The wall being thinner than the average wall thickness in the area adjacent the first lead channel. The glass body has a second lead channel extending from the interior cavity through the wall to the exterior. A first electrical contact is formed around a sufficient portion of the exterior surface of the glass base to partially enclose the glass base, and has a weld zone positioned adjacent the thinner wall section, that is also adjacent the exterior end of the first lead channel to receive and be electrically connectable to a first lamp lead by a surface weldment. A second electrical contact is formed along the exterior surface of the glass base, and electrically separated from the first electrical contact. The second electrical contact has an electrical connection zone positioned adjacent the exterior end of the second lead channel to receive and be electrically connectable to a second lamp lead.

BEST MODE FOR CARRYING OUT THE INVENTION

Figure 1:
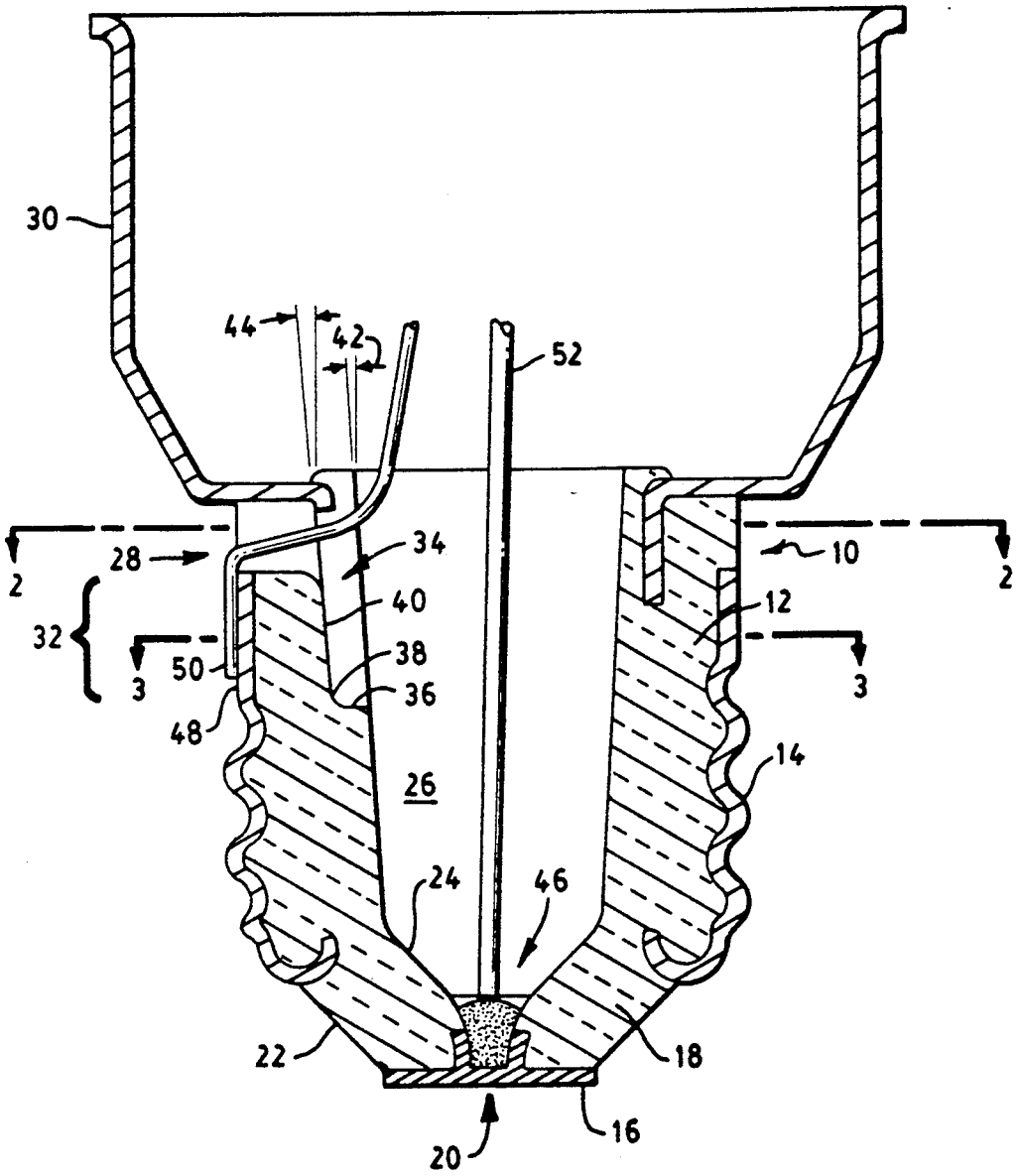
FIG. 1 shows an axial cross sectional view of a preferred embodiment of a threaded glass lamp base.

FIG. 1 shows a preferred embodiment of a glass lamp base with a stepped wall The glass lamp base 10 comprises a molded glass body 12, a shell contact 14 and a base contact 16. The molded glass body 12 roughly has the form of a cylindrical wall 18, having an axis 20, an exterior surface 22 and an interior surface 24 defining an interior cavity 26.

The glass body 12 is formed to have, extending through the wall 18 from the interior surface 24 to the exterior, a first lead channel 28. Commonly the first lead channel 28 is formed along the upper rim of the glass body 12. If a lamp skirt 30 is used, a passage through the lamp skirt 30 may be needed. The glass body 12, adjacent the first lead channel 28 is formed to have a thinned wall section 32. In the preferred embodiment, the thinned wall section 32 is narrowed along the interior surface 24 by an internal step 34. The internal step 34, in the preferred embodiment then projects along a step base 36 roughly 90° away from the axis 20, outwards towards the exterior, and then by means of a rounded corner 38 forms a step rise 40 roughly at right angles to the step base 36 to again roughly parallel the axis 20. To accommodate withdrawal of the molding tools, the central cavity 26 is formed with an internal angle 42, for example of about 5° to the axis 20, to accommodate tool withdrawal. The step rise 40 may similarly be formed with an angle 44 to the axis 20 that is convenient for tool withdrawal.

The glass body 12 is further formed to have a second lead channel 46 extending through the wall 18 from the interior cavity 26 to the exterior. Commonly the second lead channel 46 is formed to be at the axial end of the lamp base 10.

Adjacent the exterior of the glass body 12, is the shell 14. The shell 14 extends along a portion of the exterior surface 22 of the glass body 12 may comprise a threaded shell typical of standard Edison type lamps, or may comprise bayonet or similar generally cylindrical shaped exterior shell contacts for lamp bases. The shell 14 is commonly made of brass, or a similar easily formed, conductive metal. A portion of the shell 14 is located adjacent the exterior opening of the first lead channel 28, and opposite the thinned wall section 32 forming a weld zone 48. Electrical connection may be made to the shell 14 by ducting through the first lead channel 28 and then welding to the weld zone 48 a first lamp lead 50. The shell 14 thereby forms a first socket contact for lamp operation.

Also adjacent the exterior of the glass body 12, but electrically separated from the shell 14 is the base contact 16. The base contact 16 extends along the exterior surface 18 of the glass body 12, electrically connected to a second lead 52, an eyelet having a passage therethrough to receive the second lamp lead 52 positioned coaxial with the lamp base 10, at an end of the lamp base 10 opposite the light source. The second lamp lead 52 may then be ducted through the eyelet and either soldered, or welded to the eyelet. The soldered or welded eyelet then forms a second socket contact for the lamp base.

The thickness of the wall 18 adjacent the weld zone 48 should be thin enough to cool more rapidly than the adjacent wall areas, thereby tending to seal first with the shell 14, and deter slumping of the glass adjacent the weld zone 48. It is estimated that a wall thickness reduced by about one third is sufficient to adequately differentiate the cooling rates of the respective wall sections. The step wall thinkness opposite the weld zone should not be so thin as to break under the pressure of the weld tool pressing the lead to the shell. It is estimated that a wall thickness of 3.175 mm (0.125 inch) is sufficient to withstand the pressure of most weld tools.

Figure 2:
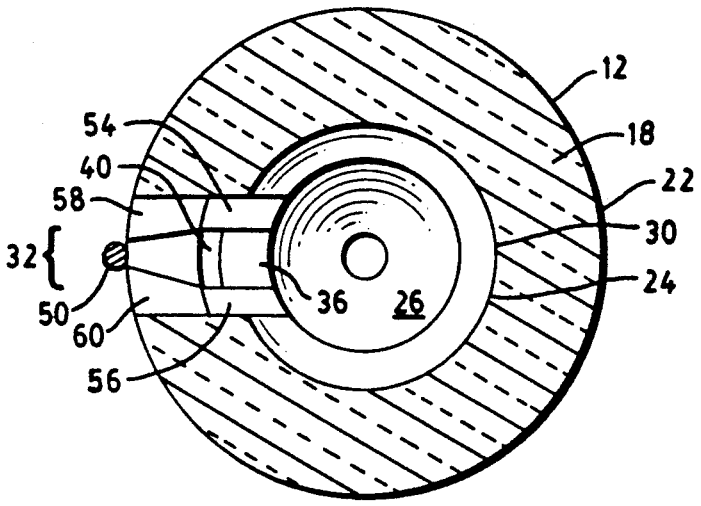
FIG. 2 shows a transverse cross sectional view from 2—2 of the lamp base of FIG. 1.

FIG. 2 shows a transverse cross sectional view from 2—2 of the lamp base of FIG. 1. Angled at about 45° to the vertical axis 20, and parallel to the lead channel 28 are inner side walls 54, 56, of the first lead channel 28. Angled at about 45° to the vertical axis 20, and about 30° to the lead channel 28 are outer side walls 58, 60, of the first lead channel 28. The outer side walls 58, 60 tend to close off the exterior end of the lead channel 28.

Figure 3:
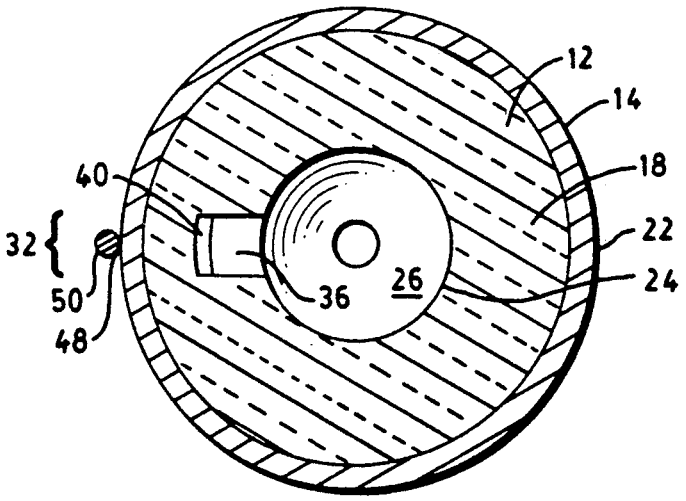
FIG. 3 shows a transverse cross sectional view from 3—3 of the lamp base of FIG. 1.

FIG. 3 shows a transverse cross sectional view from 3—3 of the lamp base of FIG. 1. The interior step 34 may be roughly rectangular provided there is some wall slope to allow tool withdrawal. The thinned wall section 32 formed by the interior step 34 is adjacent the weld zone 48. The lead channel 28 is formed by the sloped side walls 54, 56, 58, and 60.

Figure 4:
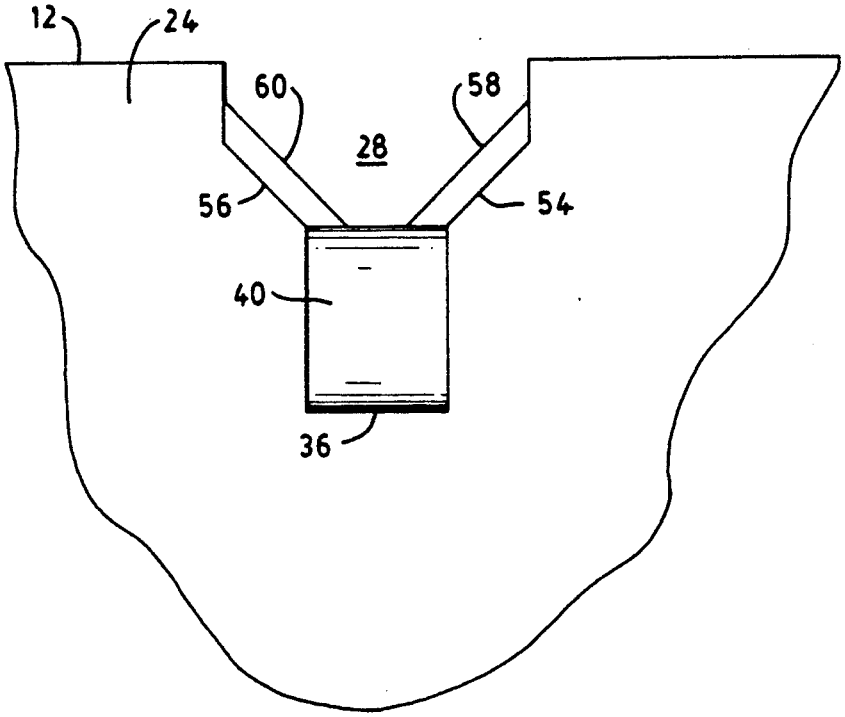
FIG. 4 shows an elevational view from the inside of the lamp base cavity showing the stepped wall partially broken away.

FIG. 4 shows an elevational view from the inside of the lamp base cavity showing the stepped wall partially broken away. The view is from the inside of the glass body 12, looking out through the first lead channel 28. The edge of the step 36 is shown backed by the indentation of the tapered step rise 40, leading to the first lead passage 28. The edge of the step 36 and step rise 40 form two planar sides of the indented boxy interior step. The first lead channel 28 is shown with sloped side walls 54, 56. The boxy interior step may be seen located below a notched like passage formed at the rim of the glass body.

Figure 5:
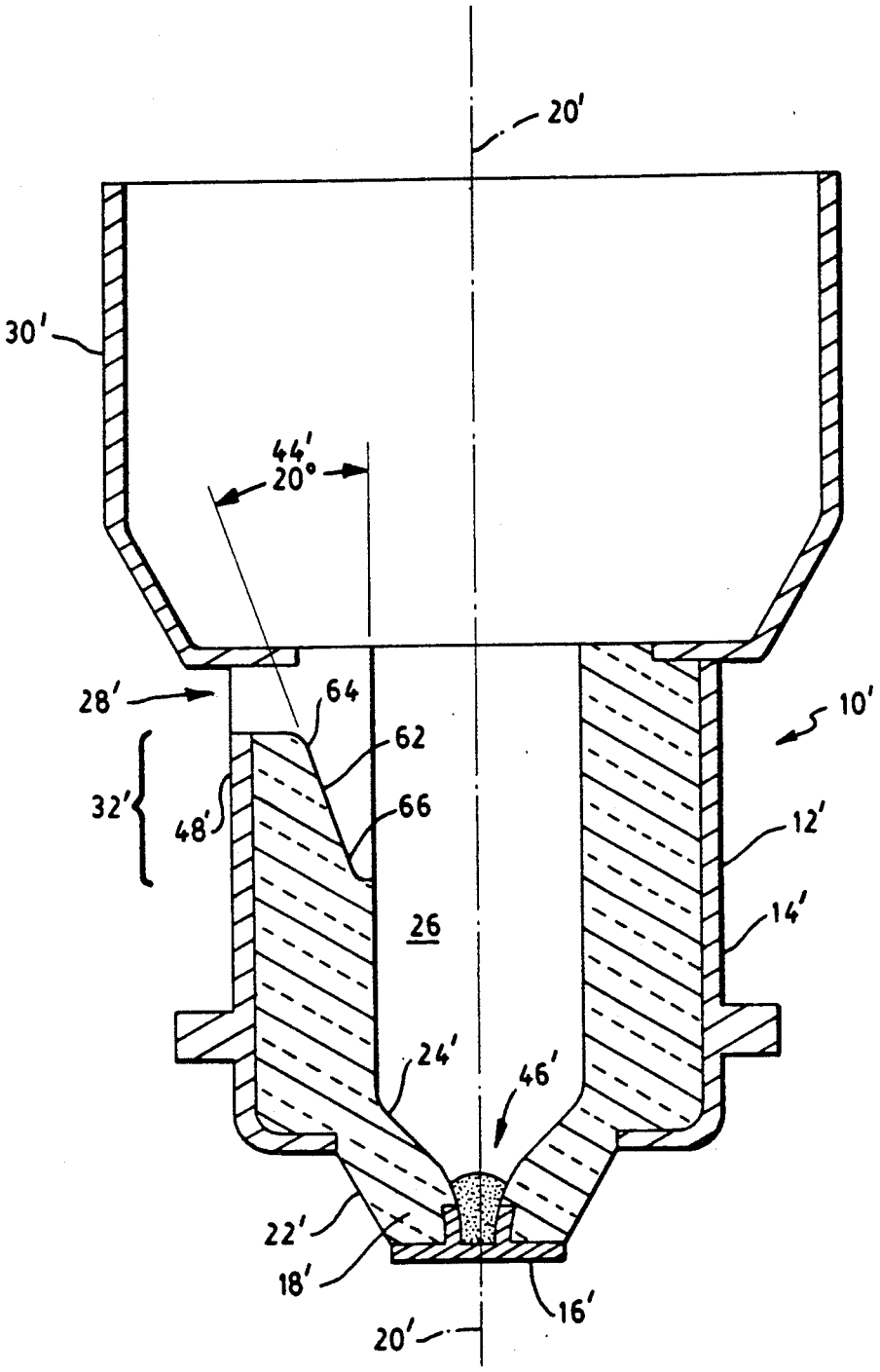
FIG. 5 shows an alternative embodiment of a bayonet glass lamp base.

FIG. 5 shows a less preferred alternative embodiment of a bayonet glass lamp base having corresponding elements of FIG. 1 with a prime on it. Instead of thinning the glass body wall with an interior step, an interior slope 62 may be used. The interior slope 62 may narrow the upper region 64 of the adjacent lead channel too much thereby allowing the pressure of the weld tool to crack the glass body adjacent the weld zone. Simultaneously, the lower region 66 of the slope may remain too thick, thereby still tending to slump or pull away from the shell. The use of a slope 62 to form a thinned wall region opposite the weld zone is therefore a less preferred method of thinning the wall. A slope of about 20° was tried and was found to be an improvement but not totally satisfactory.

To complete a lamp with the disclosed base, the lamp base 10 is electrically coupled to a light source having two or more electrical leads. The electric light source has a first lead extending through the first lead channel, and a second lead extending through the second lead channel. A lamp envelope encloses the light source, and couples to the glass body 12 to complete the lamp assembly.

In a working example some of the dimensions were approximately as follows: The eyelet was an annulus with a turned in inner edge having an outer diameter of 11.09 mm (0.437 inch) and an inner diameter of 1.21 mm (0.048 inch). The shell was a medium base brass threading comprising a threaded cylindrical piece with an outer diameter of 27.00 mm (1.063 inch), with a funneled and then curled in base end, and a cylindrical lamp end. The skirt had a cylindrical base end 19.05 mm (0.75 inch) in diameter, and a lamp end about 38.1 mm (1.5 inch) in diameter. The glass base was a press glass molding roughly in the form of a thick walled cylinder with a funneled base end. The second lead exit was 1.21 mm (0.048 inch) in diameter with a 70° taper leading to a 90° taper. The glass base had an axial length of about 28.93 mm (1.139 inch), a outside diameter of 27.00 mm (1.063 inch), and interior diameter of 14.22 mm (0.56 inch) narrowing at about 4°. A step was formed in the lamp end of the glass base adjacent the second lead exit. The step had an axial length of about 6.35 mm (0.25 inch), and a radial depth of about 3.17 mm (0.125 inch). The step tapered at about 5°. The first exit channel had a diameter of about 3.81 mm (0.15 inch) allowing the first lamp lead to be extended through to the exterior, and then welded to the adjacent shell. With the above working example, several million lamp bases have been made without a single void defect being detected.

In experimental designs, the step rise 40 was formed to a have a slope angle of about 20°. While there was some improvement in the weld to have a wall thickness in the weld zone 32 at a rate of about 45° to the axis of the second exit channel wall being thinned in the area adjacent the first lead channel. The bottom of the step was then still fairly thick, and was found to still be subject to slumping, thereby resulting in a gap between the glass body and the shell. The 20° sloped step is then only a less preferred form of the present improvement. By making the step rise with a 5° angle, it was found that the glass body in opposite the weld zone, cooled quickly as an area and did not slump away from the shell contact. Further, the thickness of the glass body in the step rise region was still uniformly thick enough to resist chipping or breaking during welding. As a result, virtually all of the lamps made according to the 5° step rise structure have been welded successfully. The disclosed dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A glass lamp base comprising:

a) a molded glass base in the general form of a cylindrical walled body, having an axis, an exterior surface and an interior surface defining a first wall thickness therebetween, the interior surface further defining an interior cavity, and having a first lead channel extending from an interior end adjacent the interior cavity through the wall to an exterior end adjacent the exterior surface, the wall being thinner than the average wall thickness in the area adjacent the first lead channel, and a second lead channel extending from the interior cavity through the wall to the exterior, b) a first electrical contact formed around a sufficient portion of the exterior surface of the glass base to partially enclose the glass base, and having a weld zone positioned adjacent the thinner wall section, and adjacent the exterior end of the first lead channel to receive and be electrically connectable to a first lamp lead by a surface weldment, and c) a second electrical contact formed along the exterior surface of the glass base, and electrically separated from the first electrical contact, and having an electrical connection zone positioned adjacent the exterior end of the second lead channel to receive and be electrically connectable to a second lamp lead.

2. The apparatus in claim 1, wherein the second electrical contact comprises an eyelet having a passage therethrough to receive the second lamp lead.

3. The apparatus in claim 2, wherein the eyelet is positioned coaxial with the lamp base, at an end of the lamp base.

4. The apparatus in claim 1, wherein the first electrical contact comprises a metal shell in the general form of a cylinder for making an electrical connection.

5. The apparatus in claim 4, wherein the shell has a threaded cylindrical portion, positioned coaxial with the lamp base.

6. The apparatus in claim 1, wherein the glass base has a tapered step adjacent the first lead channel to narrow the first wall thickness in the area of the weld zone, the taper of the tapered step being less than 20° with respect to the axis.

7. The apparatus in claim 6 wherein the glass base has a tapered step reducing the first wall thickness adjacent the first lead channel in the area of the weld zone, the taper of tapered step being less than 5° with respect to the axis.

8. The apparatus in claim 1, wherein the glass base has a step reducing the first wall thickness adjacent the first lead channel in the area of the weld zone, the step having a base extension into the wall extending at least one third of an average depth of the wall thickness.

9. The apparatus in claim 8, wherein the step has a rise extending to the first lead channel, and has a taper of about 5° to the axis.

10. The apparatus in claim 1, wherein the thinned wall axially extends for a distance of about twice the length of the weld zone.

11. A glass lamp base comprising:

a) a molded glass base in the form of a walled body having an axis, an upper rim, an exterior surface and an interior surface defining a first wall thickness between the exterior surface and the interior surface adjacent the upper rim, the interior surface further defining an interior cavity, and having a first lead channel extending from the interior cavity through the wall to the exterior, and a second lead channel extending from the interior cavity through the wall to the exterior, the glass base having a tapered wall adjacent the first lead channel to narrow the wall thickness at a rate less than about 20° to the axis, the wall thereby being thinned in the area adjacent the first lead channel, b) means for making a first electrical contact along the exterior surface of the glass base comprising a shell, positioned coaxial with the lamp axis, having a portion positioned adjacent the exterior end of the first lead channel, and electrically connectable to a first lamp lead by an exterior surface weldment, c) means for making a second electrical contact positioned coaxial with the lamp base, at an end of the lamp base, having a passage therethrough to receive and be electrically connected to a second lamp lead, the second contact means being electrically separated from the first contact means, and d) a lamp skirt in the form of a stepped cylindrical shell with an axial facing lip captured in the upper rim of the glass lamp base.

12. The apparatus in claim 11, wherein the tapered wall adjacent the first lead channel in the area of the weldment tapers at a rate of about 5° to the axis.

13. The apparatus in claim 11, wherein the glass base has a tapered wall adjacent the first lead channel to narrow the first wall thickness in the area of the weldment to about two thirds of the adjacent first wall thickness.

14. The apparatus in claim 11, wherein the tapered wall adjacent the first lead channel in the area of the weldment has a step width of about one half the adjacent first wall thickness.

15. The apparatus in claim 11, wherein the glass base has a tapered wall adjacent the first lead channel to narrow the first wall thickness in the area of the weldment.

16. The apparatus in claim 11, wherein the tapered wall adjacent the first lead channel in the area of the weldment tapers from the adjacent wall thickness to a step width of about one half the adjacent first wall thickness.

17. The apparatus in claim 11, further including a lamp skirt in the form of a stepped cylindrical shell with an axial facing lip captured in an axial end of the lamp base nearest of the first lead channel.

* * * * *